US005647636A

United States Patent [19]

Allen

[11] Patent Number: 5,647,636

[45] Date of Patent: Jul. 15, 1997

[54] SUSPENDED SEATING DEVICE

[75] Inventor: Carling D. Allen, Orem, Utah

[73] Assignee: Seating Innovations L.L.C., Orem, Utah

[21] Appl. No.: 526,836

[22] Filed: Sep. 12, 1995

[51] Int. Cl.[6] ..... A47C 1/02

[52] U.S. Cl. ..... 297/344.21; 248/324; 248/285.1

[58] Field of Search ..... 297/337, 344.1, 297/344.18, 344.21, 344.22, 344.26, 440.24, 440.1, 217.7, 217.1; 248/324, 285.1, 289.11; 312/235.2, 235.9

[56] References Cited

U.S. PATENT DOCUMENTS

| | | | |
|---|---|---|---|
| 1,271,170 | 8/1918 | Jelliack et al. | 297/344.22 X |
| 2,306,812 | 12/1942 | Ketive | 297/217.7 X |
| 3,131,964 | 5/1964 | Reed | 297/344.22 X |
| 3,142,513 | 7/1964 | Skokat | 297/344.1 X |
| 3,428,976 | 2/1969 | Robinson | 297/344.18 X |
| 4,030,749 | 6/1977 | Straham | 297/344.18 |
| 5,251,959 | 10/1993 | De Braal et al. | 297/344.1 |
| 5,335,970 | 8/1994 | Bryant | 294/244.22 |

*Primary Examiner*—Milton Nelson, Jr.
*Attorney, Agent, or Firm*—M. Ralph Shaffer P.C.

[57] ABSTRACT

Suspended seating construction comprising a chair supporting device having L-shaped structure constructed for selected mounting to the wall and associated cabinetry; a mount to the cabinetry supports both the swing arm accommodating the suspended seating and additionally precludes failure of wall mount structure incorporated in the device.

12 Claims, 3 Drawing Sheets

SUSPENDED SEATING DEVICE

FIELD OF INVENTION

The present invention related to suspended seating constructions and, more particularly, provides a suspended seating device suitable for mounting to walls and associated cabinets, desks, consoles, and the like.

BRIEF DESCRIPTION OF PRIOR ART

There is considerable patent literature, including some of the inventor's own prior patents, which relate in general to suspended seating. The literature generally teaches the concept of suspended seating useful for supplying seating for counter tops, tables, kitchen bars, and the like, wherein there is no direct support underneath the seat and engaging the floor. Rather, the seating customarily employs an arm that swivels in its journal mount related in one way or another to the counter top or table which it is associated.

A problem has occurred in providing suitable suspended seating constructions directed to wall mounts, cabinetry, and the like, and no art is known for providing a wall mount-type structure wherein the suspended seating is both supported relative to cabinetry and is likewise constructed to preclude failure of the mount of the device at wall support structures.

BRIEF DESCRIPTION OF THE INVENTION

Accordingly, the present invention addresses the goal of supplying, by way of suspended seating apparatus, a chair/stool supporting device suitable for mounting both to a building wall and also to cabinetry extending forwardly from such wall, the device being constructed to be incorporated underneath a desktop or table proximate the cabinetry and also generally underneath the wall mount structure supporting such device. Bracket assemblies incorporating channel elements are employed for receiving a primary elongated member of the subject chair supporting device, the bracket assemblies themselves being affixed to the wall by threaded attachments passing therethrough and into the wall studs. An elongated support arm projects forwardly of the aforementioned elongated member and, in a preferred form of the invention, telescopes into a mount member provided a journal receiving and retaining a swivel-type chair support arm. The mount member incorporates structure which protrudes into and fastens against the cabinetry that is associated with, built into, or set proximate a room wall. This structure both supports a chair support arm provided and additionally prevents a twisting of the device about a horizontal axis such as to tend to cause a failure at bracket assembly locations, or a twisting out of the bracket assemblies of the elongated member provided.

The chair support arm is itself provided a lower, vertically oriented journal that receives the stub shaft of a chair/stool bottom support plate. Both upper and lower journals of the chair support arm, as included, may be provided with stop abutment structure for delimiting pivotal rotation, about respective vertical axes, of the chair support arm and seat support plate, so that the chair support arm and seat journal will not proceed past particular limits of travel of the said arm and seat, as regards vertical pivotal movement.

OBJECTS

Accordingly, a principal object of the present invention is to provide a new and improved chair- or seat-supporting device in suspended seating constructions.

A further object is to provide a chair supporting device which is uniquely constructed for ease of securement to both a wall and also to cabinetry proceeding forwardly and disposed proximate such wall.

An additional object is to provide L-shaped structure in a suspended seating construction which is easy to install and which is supported at its forward projecting arm so as to preserve the integrity of the suspended seating function, as well as to preclude wall mount failure.

BRIEF DESCRIPTION OF DRAWINGS

The present invention, both as to its organization and manner of construction, is best understood by reference to the following drawings, taken in connection with the description that follows, in which.

DETAILED DESCRIPTION OF PREFERRED EMBODIMENTS

Figure 1:
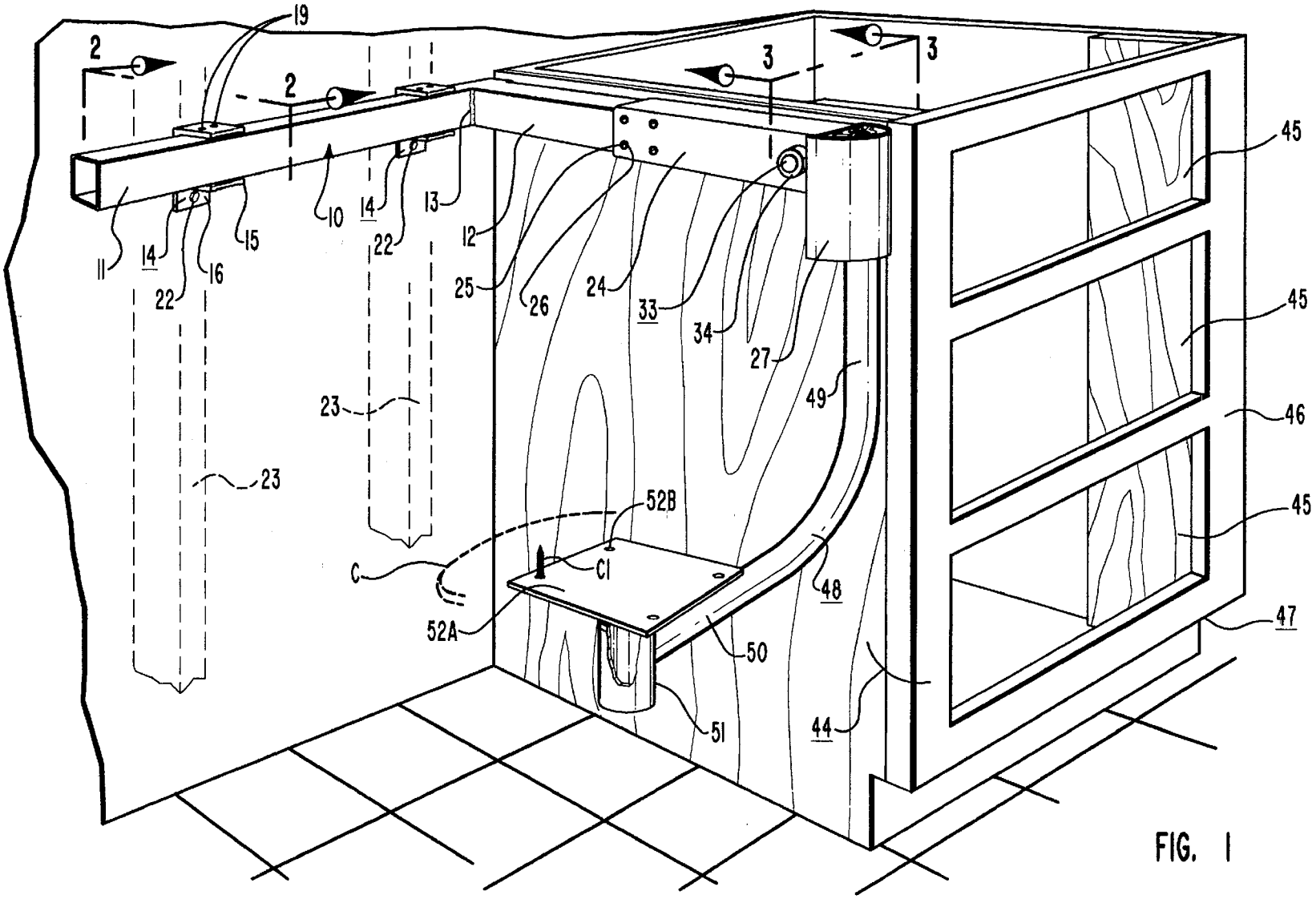
FIG. 1 is a perspective view of a chair supporting device shown in its installed condition.

In FIG. 1 the chair supporting device 10 is shown to include an elongated member 11. Member 11 may comprise a hollow tube extrusion having a generally square cross section.

Figure 2:
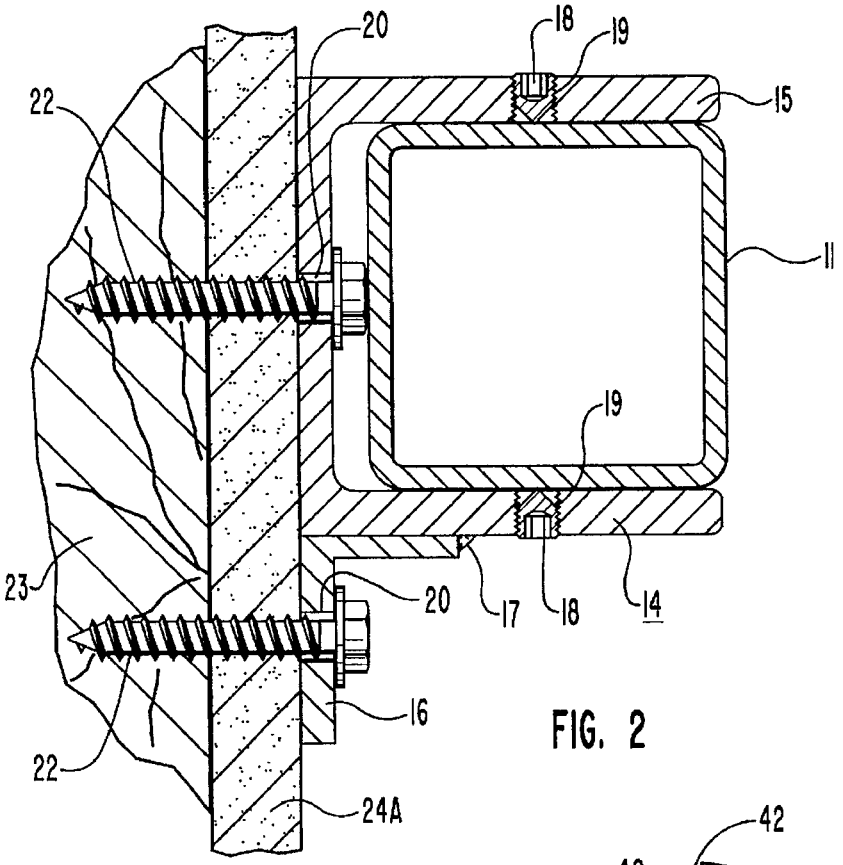
FIG. 2 is an enlarged fragmentary section taken along the line 2—2 in FIG. 1.

Elongated support member 12 is secured as by welding at 13 to elongated member 11 and projects forwardly in a normal, i.e. perpendicular direction relative to the orientation of member 11. The room wall to which the device is to be attached has several, vertical, parallel studs 23, two of which are shown in phantom line and over which drywall sheeting 24A, see FIG. 2, is positioned in a customary manner. Bracket assemblies 14, see FIGS. 1 and 2, will include respective channel members 15 and also angles 16 which are welded at 17 to the respective channel members 15. Members 15 include threaded apertures at 19 designed for the reception of set screws such as allen screws 18.

Each bracket assembly 14, see FIG. 2, will include a pair of apertures 20 for the reception of the pair of threaded attachments 22 which can take the form of screws, lag bolts, and so forth. Allen screws 18 may vary in number, top and bottom, see FIG. 1, for securement of elongated member 11 and in any event are designed for the fixed securement of elongated member 11, once correctly positioned along its longitudinal axis. This correct positioning, of course, will be determined by the particular location of cabinet 47 and, particularly, the cabinet portion, i.e. cabinet construction wall 44 as seen in FIG. 1.

Figure 3:
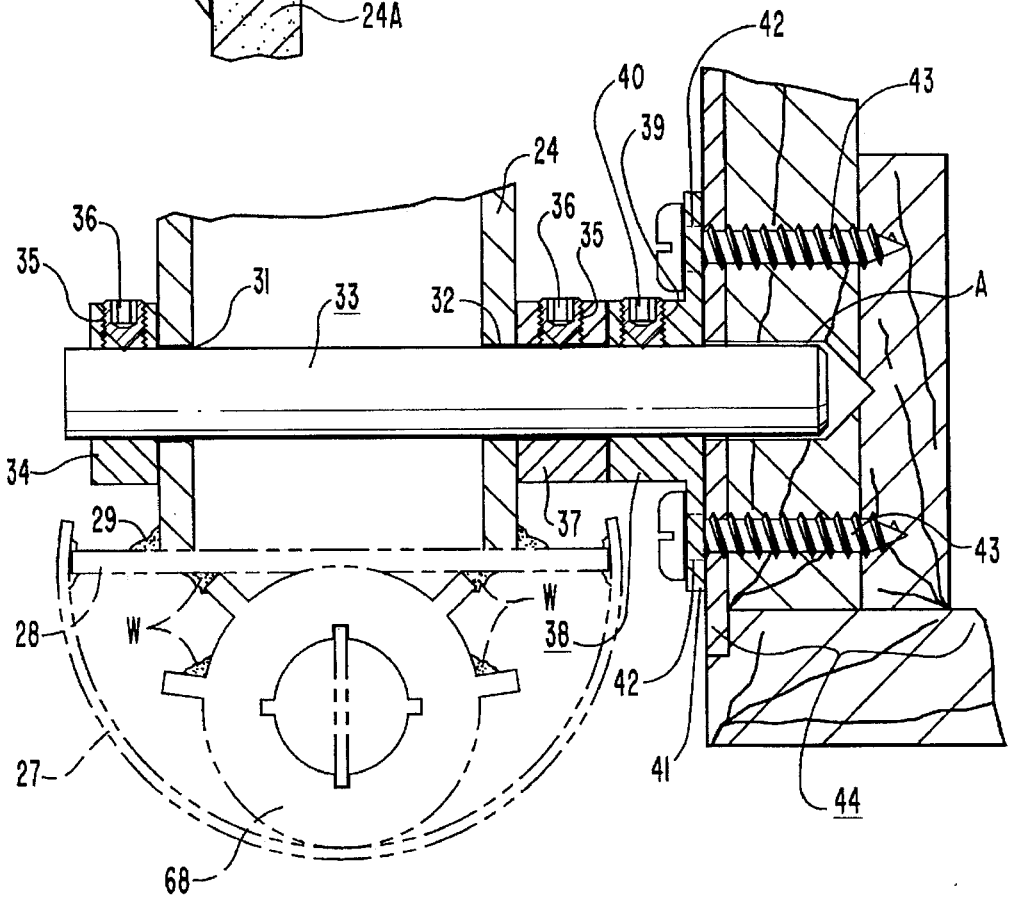
FIG. 3 is an enlarged fragmentary section, partially shown in phantom lines, and taken along the line 3—3 in FIG. 1.

Prior to the placement of elongated member 11 within the bracket assemblies 14, mount member 24, see FIG. 1, will be slipped over elongated support member 12 in a telescoping manner. The positioning of connector 33 is to be noted, and aperture A, see FIG. 3, will be drilled for the support and reception of connector 33. Connector 33 may take the form simply of a cylindrical stub shaft as seen, and be provided with three collars 34, 37, and 38 as seen in FIG. 3. When the collars are appropriately positioned, their respective allen screws/set screws at 36 and 40 will be threaded down into their respective threaded apertures 35 and 39 to engage the connector 33 and fix the positions of the collars relative thereto. Collar 38 is provided with a circular flange as seen at 41, and the same is provided with multiple apertures 42 designed for the reception of threaded attachments 43 such as the screws shown. These screws are employed for the affixing of the flange 41 and hence its collar 38 to the cabinet portion or cabinet wall at 44. Conceivably, of course, elongated members 12 and 24 may comprise a unitary part, though a two-part structure is preferred.

Aligned apertures 31 and 32 are provided in mount member 24 and provide for the support of the forward end of connector 33, and hence provide, with the cabinet wall surrounding aperture A, support for elongated support member 12 in a fixed manner. In this way, the entire construction is precluded from pivoting about the longitudinal axis of elongated member 11 in a clockwise direction, looking toward the right, see FIG. 1, considering the axis of elongated member 11 to be an imaginary axis of rotation. Thus, the structure is precluding from rotating or becoming disengaged from its intended mount at bracket assemblies 14.

Once the securement of the structure in FIG. 3 is completed, then the allen screws 18 in FIG. 2, see also FIG. 1, may be tightened down to fix the relative positioning of elongated member 11 relative to the support bracket assemblies 14.

The forward end of mount member 24 is preferably provided with a vertical end plate 28, welded thereto at 29. To the opposite edges of plate 28 is welded or otherwise secured a hemicylindrical-type cover 27, the same enclosing structure including a washer-type retainer member 68, e.g. fixed to plate 28.

Figure 4:
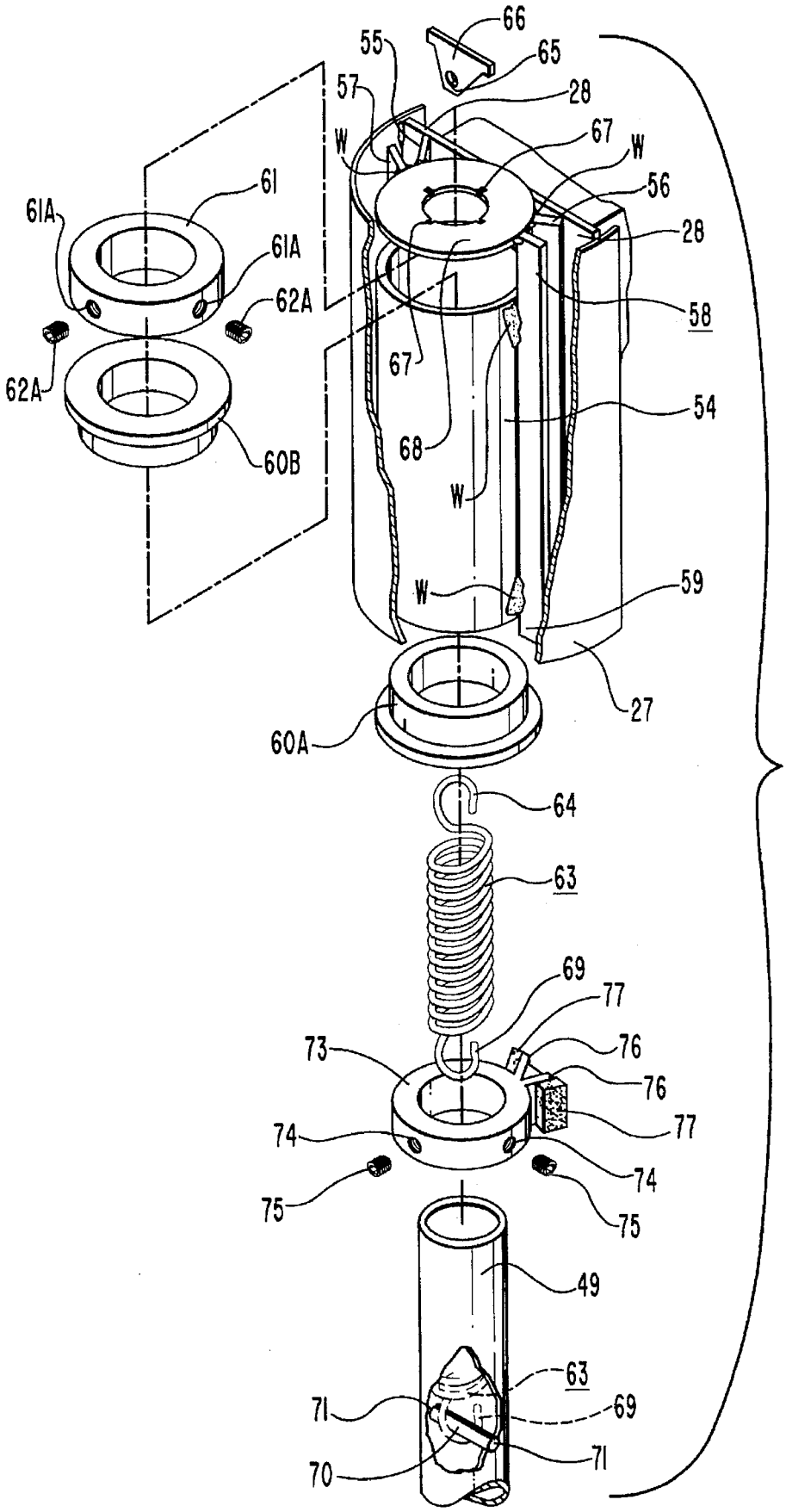
FIG. 4 is an exploded perspective view of structure employed by the device relative to attachment of a swivel arm support, intended for supporting the chair, seat or stool to be affixed to and supported by the device.

In referring to FIGS. 1 and 4 it is seen that a chair C, and which includes a chair or seat, will be mounted to plate 52A by virtue of suitable attachments, see representative attachment C1, passing through apertures 52B. Depending from plate 52A is a stub shaft 52, received by and journaled in journal box 51, the latter being affixed to the end of arm portion 50.

Chair support arm 48 in FIG. 1 includes an upper arm portion 49, see also FIG. 4, which is provided with a pin retainer such as a roll pin at 70 that is secured in aligned apertures 71. This roll pin receives the lower spring retainer end 69 of torsion spring 63. The upper retainer end of spring 63, i.e. end 64, proceeds through aperture 65 of triangular key 66 at the upper portion of the drawing. To the upper arm portion 49 is affixed collar 73, the latter being provided with threaded apertures 74 and allen screws or set screws 75. Collar 73 is provided with bumper flanges 76 each of which includes a bumper pad 77 respectively secured thereto.

To plate 28 there may be secured a pair of depending, angulated flat bars 55 and 56 which are welded to the plate and also to cylindrical sleeve 54. Of course, a welded or other fastening construction can be used to secure the cylindrical sleeve 54 to plate 28. Elongated fins 57 and 58 may be welded as at W to the exterior of cylindrical sleeve 54 as indicated and have respective elongated fin extremities 59 proceeding downwardly beneath the lower end of cylindrical sleeve 54. These lower extremities, as at 59, can be employed as stops or stop abutments for selected coaction with the bumper pads 77 of bumper flanges 76 of the collar 73. Accordingly, the rotation in opposite directions of upper arm 49 about its vertical axis will be delimited in a matter pre-designed into the system.

Receiving the upper arm portion 49 of arm 48 are a pair of oil impregnated bronze bearings 60A and 60B which will be positioned in the opposite ends of cylindrical sleeve 54. These bronze bearings will journal the upper arm portion 49. Collar 61, again, is secured to the upper extremity of upper arm portion 49 and retains the same in a desired condition through the employment of set screws or allen screws 62A at threaded apertures 61A.

It is noted that the washer-type retainer member 68 includes a series of diametrically opposed slots 67. These selectively receive the opposite sides of triangular key 66 which is placed appropriately, to produce the proper torsion effect relative to spring 63. Again, the upper, hooked end 64 of such spring engages aperture 65 of triangular key 66.

In operation, the chair supporting device or suspended seating device at 10 operates as follows. Elongated member is slipped into the pre-installed bracket assemblies 14 and, before tightening the allen screws associated therewith, the outwardly extending elongated support member 12 may be provided with telescoping mount member 24. When the point of attachment relative to connector 33 is assessed, then, prior to the installation of connector 33, the aperture A is drilled through the cabinet construction as shown in FIG. 3. Subsequently, the several collars as seen in FIG. 3 are installed in conjunction with the placement of connector 33, and the allen screws or set screws at 36 and 40 are tightened for secure retention of connector 33. Then, the screws or threaded attachment members 43 are employed to secure the circular flange 41 of collar 38 directly to the side of the cabinetry at 44.

Subsequent to this operation the set screws or allen screws at 25 are tightened so as to fix the disposition of elongated support member 12 relative to mount member 24.

At this point the placement of elongated member 11, previously slidable within bracket assemblies 14, becomes determined so that the set screws at 18 in FIG. 2 may likewise be tightened down.

Pre-assembled to mount member 24 will be the structure contained within the hemicylindrical cover 27, see FIG. 4—the upper portion thereof. The assembly of the entire construction shown in exploded view in FIG. 4 has previously been described. With the chair support arm 48 now in place, then the structure at its journal, likewise previously described as to elements in assembly, is now complete, thus providing a support plate or seat plate 52A relative to the chair C to be attached by suitable attachments at 52B to the plate 52A. It is noted finally that the securement of the connector structure at 33 with its collars, and so forth, will adequately support the suspended seating, co-acting for this purpose with bracket assemblies 14. A cabinet/desktop/tabletop will subsequently be disposed over the cabinetry and also the upper flanges of bracket assemblies 14, so that the device, save for the chair attachment, is substantially hidden from view. As to the cabinetry, door openings 45 are contained within front panel 46 of cabinet 47.

While particular embodiments of the present invention have been shown and described, it will be obvious to those skilled in the art that various changes and modifications may be made without departing from the essential features of the invention and therefore, the aim in the appended claims is to cover all such changes and modifications as fall within the true spirit and scope of the invention.

I claim:

1. A suspended seating device including, in combination, first elongated means for adjustable securement to a wall; second elongated means extending forwardly in a direction normal to said first enlongated means, said second elongated means having a rearward end affixed to said first elongated means and also a forward end; attachment means for affixing said forward end to external cabinet structure; a curved, suspending seating chair support arm having an upper vertical arm portion and also a lower, laterally extending arm portion; seating structure attached to and above said lower arm portion, and journal structure secured to said forward end of said second elongated means and supportingly receiving and journalling said upper arm portion.

2. The suspended seating device of claim 1 wherein said first elongated means has first and second opposite ends, said rearward end of said second elongated means being affixed to said first elongated means proximate said second opposite end.

3. The suspended seating device of claim 1 wherein said first elongated means has first and second opposite ends, said rearward end of said second elongated means being welded to said first elongated means proximate said second opposite end.

4. A suspended seating device according to claim 1 wherein said attachment means includes a flanged attachment mountable to said external cabinet structure.

5. The suspended seating device of claim 1 wherein said first elongated means comprises an elongated bar-type member and plural bracket assemblies mounted upon and releasably secured to said elongated bar-type member and constructed for mounting to and over external wall studs.

6. The suspended seating device of claim 5 wherein said bracket assemblies having respective attachment apertures, and headed attachment means cooperating with said apertures for securing said bracket assemblies to said external wall studs.

7. The suspended seating device of claim 6 wherein said bracket assemblies include respective, mutually horizontally aligned channel members each having set screws, said elongated member being mounted with said channel members and positioned in place by said set screws.

8. The suspended seating device of claim 1 wherein said second elongated means comprises a telescoping construction having an inner member secured to said first elongated means and an external tubular member telescopingly receiving said inner member, said external tubular member having attachment means for fixing the location of said inner member to and within said external tubular member, said journal structure being secured to said external tubular member proximate the latter's forward end.

9. The suspended seating device of claim 8 wherein said forward end of said second means includes a fixed end plate, said journal structure being secured to said end plate.

10. A suspended seating device including, in combination, first elongated means for adjustable securement to a wall; second elongated means extending forwardly in a direction normal to said first elongated means, said second elongated means having a rearward end affixed to said first elongated means and also a forward end; attachment means for affixing said forward end to external cabinet structure; a curved, suspending seating chair support arm having an upper vertical arm portion and also a lower, laterally extending arm portion; seating structure attached to and above said lower arm portion, and journal structure secured to said forward end of said second elongated means and supportingly receiving and journalling said upper arm portion, said journalling structure and upper vertical arm portion each being provided with mutually cooperable respective means for delimiting the extent of arcuate rotation of said support arm, and said seating structure being journaled to said lower arm portion.

11. The suspended seating device of claim 10 wherein said seating structure and lower arm portion being provided with respective, mutually cooperable means for delimiting arcuate rotation of said seating structure relative to said support arm.

12. A suspended seating device including, in combination, first elongated means for adjustable securement to a wall; second elongated means extending forwardly in a direction normal to said first elongated means, said second elongated means having a rearward end affixed to said first elongated means and also a forward end; attachment means engaging said forward end for affixing said forward end to external cabinet structure, said attachment means including a shaft affixed to and horizontally passing through said second end and provided with flange means for fixedly aligning said shaft with a selected position relative to said external cabinet structure; a curved, suspending seating chair support arm having an upper vertical arm portion and also a lower, laterally extending arm portion; seating structure attached to and above said lower arm portion, and journal structure secured to said forward end of said second elongated means and supportingly receiving and journalling said upper arm portion.

* * * * *